US006872106B2

(12) United States Patent
Kanno

(10) Patent No.: US 6,872,106 B2
(45) Date of Patent: Mar. 29, 2005

(54) PROPULSION UNIT NETWORK

(75) Inventor: Isao Kanno, Shizuoka (JP)

(73) Assignee: Yamaha Marine Kabuskiki Kaisha, Shizuoka (JP)

( * ) Notice: Subject to any disclaimer, the term of this patent is extended or adjusted under 35 U.S.C. 154(b) by 0 days.

(21) Appl. No.: 10/282,194

(22) Filed: Oct. 25, 2002

(65) Prior Publication Data

US 2003/0082962 A1 May 1, 2003

(30) Foreign Application Priority Data

Oct. 25, 2001 (JP) ..... 2001-327409

(51) Int. Cl.[7] ..... B60L 1/14
(52) U.S. Cl. ..... 440/2; 60/719
(58) Field of Search ..... 440/1, 2; 60/719, 60/700; 123/339.11, 406.53; 701/27; 324/166, 207.25; 327/4, 73

(56) References Cited

U.S. PATENT DOCUMENTS

| | | | | | |
|---|---|---|---|---|---|
| 4,435,961 | A | * | 3/1984 | Stewart | 60/719 |
| 4,649,708 | A | * | 3/1987 | Fisher | 60/700 |
| 4,708,669 | A | | 11/1987 | Kanno et al. | 440/1 |
| 4,734,065 | A | | 3/1988 | Nakahama et al. | 440/1 |
| 4,822,307 | A | | 4/1989 | Kanno | 440/1 |
| 4,836,809 | A | * | 6/1989 | Pelligrino | 440/2 |
| 4,850,906 | A | | 7/1989 | Kanno | 440/2 |
| 4,938,721 | A | * | 7/1990 | Koike | 440/2 |
| 5,043,727 | A | * | 8/1991 | Ito | 440/2 |
| 5,069,154 | A | * | 12/1991 | Carter | 440/1 |
| 5,136,279 | A | | 8/1992 | Kanno | 340/636 |
| 5,175,481 | A | | 12/1992 | Kanno | 318/588 |
| 5,209,682 | A | * | 5/1993 | Duning et al. | 440/2 |
| 5,230,643 | A | | 7/1993 | Kanno | 440/86 |
| 5,295,877 | A | | 3/1994 | Kanno | 440/2 |
| 5,352,138 | A | | 10/1994 | Kanno | 440/1 |
| 5,366,394 | A | | 11/1994 | Kanno | 440/2 |
| 5,481,261 | A | | 1/1996 | Kanno | 340/870.16 |
| 5,582,149 | A | | 12/1996 | Kanno | 123/413 |
| 5,606,952 | A | | 3/1997 | Kanno et al. | 123/413 |
| 5,615,645 | A | | 4/1997 | Kanno | 123/73 C |
| 5,685,802 | A | | 11/1997 | Kanno | 477/111 |
| 5,687,694 | A | | 11/1997 | Kanno | 123/479 |
| 5,782,659 | A | * | 7/1998 | Motose | 440/1 |
| 6,213,820 | B1 | | 4/2001 | Kanno | 440/1 |
| 6,286,492 | B1 | | 9/2001 | Kanno | 123/684 |
| 6,325,046 | B1 | | 12/2001 | Kanno | 123/406.44 |
| 6,357,423 | B1 | | 3/2002 | Kanno | 123/497 |
| 6,375,525 | B1 | | 4/2002 | Kanno | 440/87 |
| 6,377,879 | B2 | | 4/2002 | Kanno | 701/29 |
| 6,415,766 | B1 | | 7/2002 | Kanno et al. | 123/339.19 |
| 6,425,362 | B1 | | 7/2002 | Kanno | 123/179.16 |
| 6,453,897 | B1 | | 9/2002 | Kanno | 123/684 |

OTHER PUBLICATIONS

International Standard ISO 11783–5: Tractors and machinery for agriculture and forestry—Serial control and communications data network—Part 5: Network management.

National Marine Electronics Association 2000 "Standard for Serial–Data Networking of Marine Electronic Devices" (References include Main Document, Appendix A–G).

* cited by examiner

*Primary Examiner*—Lars A. Olson
(74) *Attorney, Agent, or Firm*—Knobbe, Martens, Olson & Bear, LLP

(57) ABSTRACT

A network system using a LAN to provide relative position data for a engine in a plurality of outboard motors attached to a watercraft and using that data to display engine condition information for each engine in the array of engines installed on the watercraft.

22 Claims, 9 Drawing Sheets

| Engine position |
| --- |
| 1 |

*Figure 4*

| | Remote control lever | Engine position |
|---|---|---|
| Lever/engine correspondence | First remote control lever 21a | 1, 2 |
| | Second remote control lever 21b | 3, 4 |

*Figure 6*

PROPULSION UNIT NETWORK

PRIORITY INFORMATION

This application is based on and claims priority to Japanese Patent Application No. 2001-327409, filed Oct. 25, 2001, the entire content of which is hereby expressly incorporated by reference.

BACKGROUND OF THE INVENTION

1. Field of the Invention

The present invention generally relates to the control and use of multiple propulsion units in watercraft, and more particularly to networking an array of propulsion units in a vehicle.

2. Description of the Related Art

Relatively small watercraft such as pleasure boats and fishing boats can employ a propulsion unit such as an outboard motor or a plurality of outboard motors. An outboard motor typically incorporates an internal combustion engine placed atop thereof and a propeller disposed in a submerged position when the associated watercraft rests on a surface of a body of water. The engine powers the propeller to propel the watercraft. A plurality of side by side outboard motors can be mounted on the transom of the watercraft.

Outboard motors pose unique challenges to operators when multiple outboards are used simultaneously on a watercraft. Each outboard will behave differently based on their positions on the transom. Each outboard motor in the array is capable of tilting and trimming during operation in concert with the other motors in the array or independently within the array.

One aspect of using multiple outboard motors in an array on a watercraft is that all outboard motors in the array may not produce the same thrust, and may run with different characteristics such as efficiency, power output, and durability. For example one outboard motor my begin to wear out faster, or may produce less thrust, than the others in the array.

Constructing a watercraft with multiple propulsion units creates certain difficulties. For example, when multiple outboard motors are connected to a boat, separate conduits are normally attached to each motor. In particular, a separate control cable is used to connect each throttle lever to each outboard motor. Additionally, separate conduits are used to connect each outboard motor with designated gauges mounted in the cockpit for monitoring conditions of the engine, such as engine speed and temperature. In such a marine environment, of course, all of the conduits should be protected from corrosion, and in the case of electrical conduits, protected from short circuits caused by water.

SUMMARY OF THE INVENTION

One aspect of the present invention includes the realization that the assembly of a watercraft can be simplified by using networking techniques for connecting an outboard motor with remote devices disposed in a cockpit of a watercraft. For example, all watercraft having outboard motors, except for the smallest class of such watercraft, include a cockpit disposed remotely from the outboard motor. These cockpits include at one throttle levers, and preferably, at least one gauge cluster for monitoring the conditions of the outboard motor. By using networking techniques to connect the throttle lever, gauge cluster, and the outboard motor, a single communication line can be used to connect the cockpit devices with the outboard motor. The single communication line can carry control signals from the throttle lever to the outboard motor as well as condition signals from the outboard motor to the gauge cluster.

In accordance with one aspect of the present invention, an outboard motor comprises an engine and a position module configured to store position data indicative of a mounting position of the outboard motor. The outboard motor also includes at least one sensor configured to detect a condition of the engine and to generate an engine condition signal indicative of the condition. Additionally, the outboard motor includes an output module configured to output data indicative of the condition and the position.

In accordance with another aspect of the present invention, a propulsion unit condition display comprises a position module configured to store position data indicative of a position at which a propulsion unit is mounted to a watercraft. A communication module is configured to receive a signal containing position data and propulsion unit condition data. A display device is configured to display propulsion unit condition data that is received by the communication module and which corresponds to position data stored in the position module.

In accordance with a further aspect of the present invention, a network on a watercraft comprises at least a first propulsion unit condition display configured to display a condition of a first propulsion unit connected to the watercraft. At least one sensor is configured to detect a condition of the first propulsion unit and to generate a signal including condition data indicative of the condition. A communication device is configured to transmit across the network the condition data packeted with position data indicative of a first position at which the propulsion unit is mounted to the watercraft.

In accordance with yet another aspect of the present invention, a method is provided for correlating a display device to one of a plurality of propulsion units connected to a network. The method comprises transmitting a query command requesting an identification response from all display devices and propulsion units connected to the network. The identification response includes position data. The method also includes receiving identification responses from the display devices and motors connected to the network, and determining if there are any identification responses with unique position data.

BRIEF DESCRIPTION OF THE DRAWINGS

These and other features, aspects, and advantages of the present invention will now be described with reference to the drawings of a preferred embodiment, which is intended to illustrate and not to limit the invention. The drawings comprise nine figures.

FIG. 4 is a schematic diagram illustrating position information that can be stored in any one of the position modules illustrated in FIGS. 3A–3C.

FIG. 6 is a schematic diagram illustrating position information that can be stored in any one of the position modules illustrated in FIGS. 5A–5C.

DETAILED DESCRIPTION OF THE PREFERRED EMBODIMENT

Figure 1:
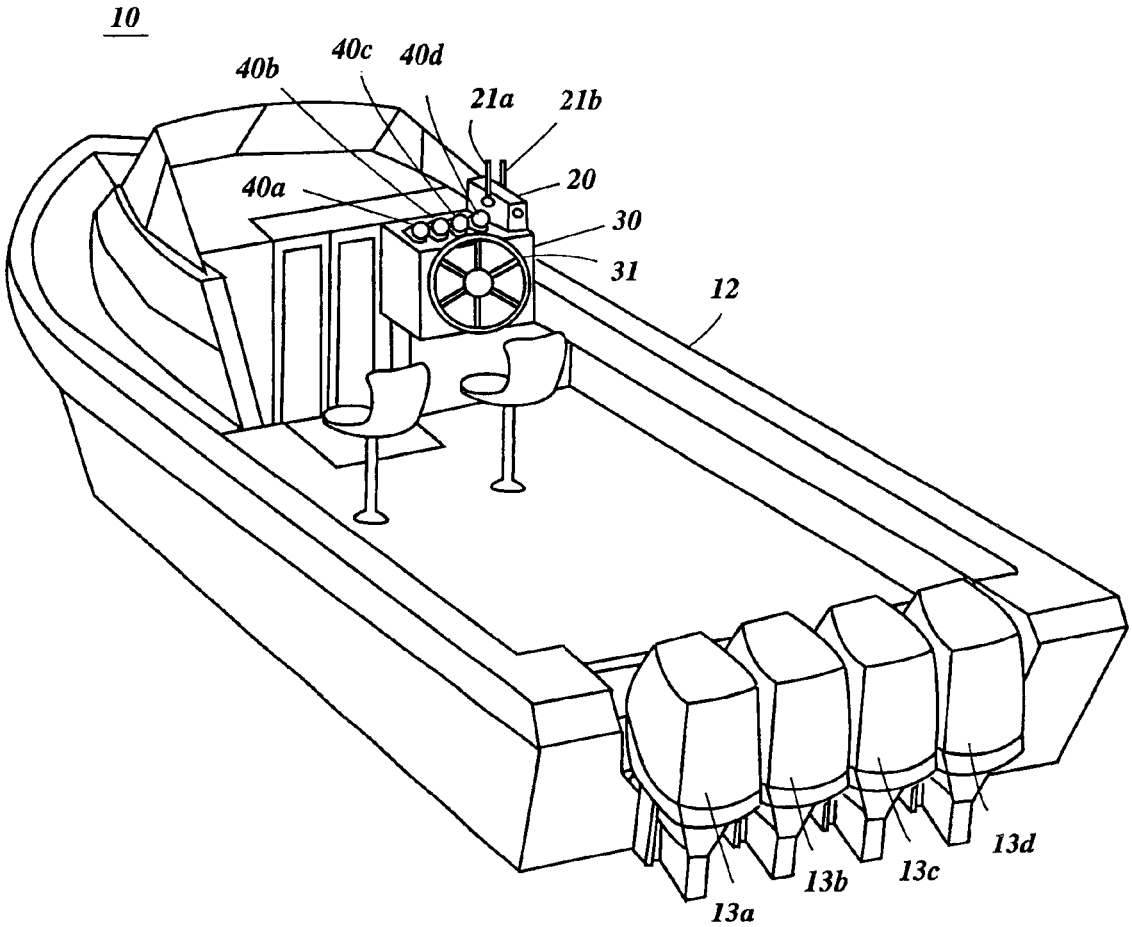
FIG. 1 is a persepctive view of a watercraft having a four outboard motors attached thereto, and a cockpit having a remote control and a plurality of gauge clusters for monitoring conditions of the outboard motors.

With initial reference to FIG. 1, a watercraft 10 advantageously includes a network connecting at least one outboard motor with at least one other components in the watercraft 10 and configured in accordance with certain features, aspects, and advantages of the present invention. The watercraft 10 provides an exemplary environment in which the network has particular utility. The network of the present invention may also find utility in applications where multiple engines are used in parallel.

As shown in FIG. 1, the watercraft 10 is comprised of a hull 12 and four outboard motors 13*a*–13*d*. The hull 12 is provided with a remote control 20 connected with remote control levers 21*a* and 21*b*, a steering unit 30 connected with a steering wheel 31, and engine condition display devices 40*a*–40*d* corresponding respectively to the outboard motors 13*a*–13*d*.

As the outboard motors 13*a*–13*d* are operated with the remote control levers 21*a*, 21*b* and the steering wheel 31, conditions of each of the outboard motors are displayed by the corresponding engine condition display devices 40*a*–40*d*. In this embodiment the remote control lever 21*a* corresponds with the outboard motors 13*a* and 13*b* and the remote control lever 21*b* with the outboard motors 13*c* and 13*d*, respectively.

Figure 2:
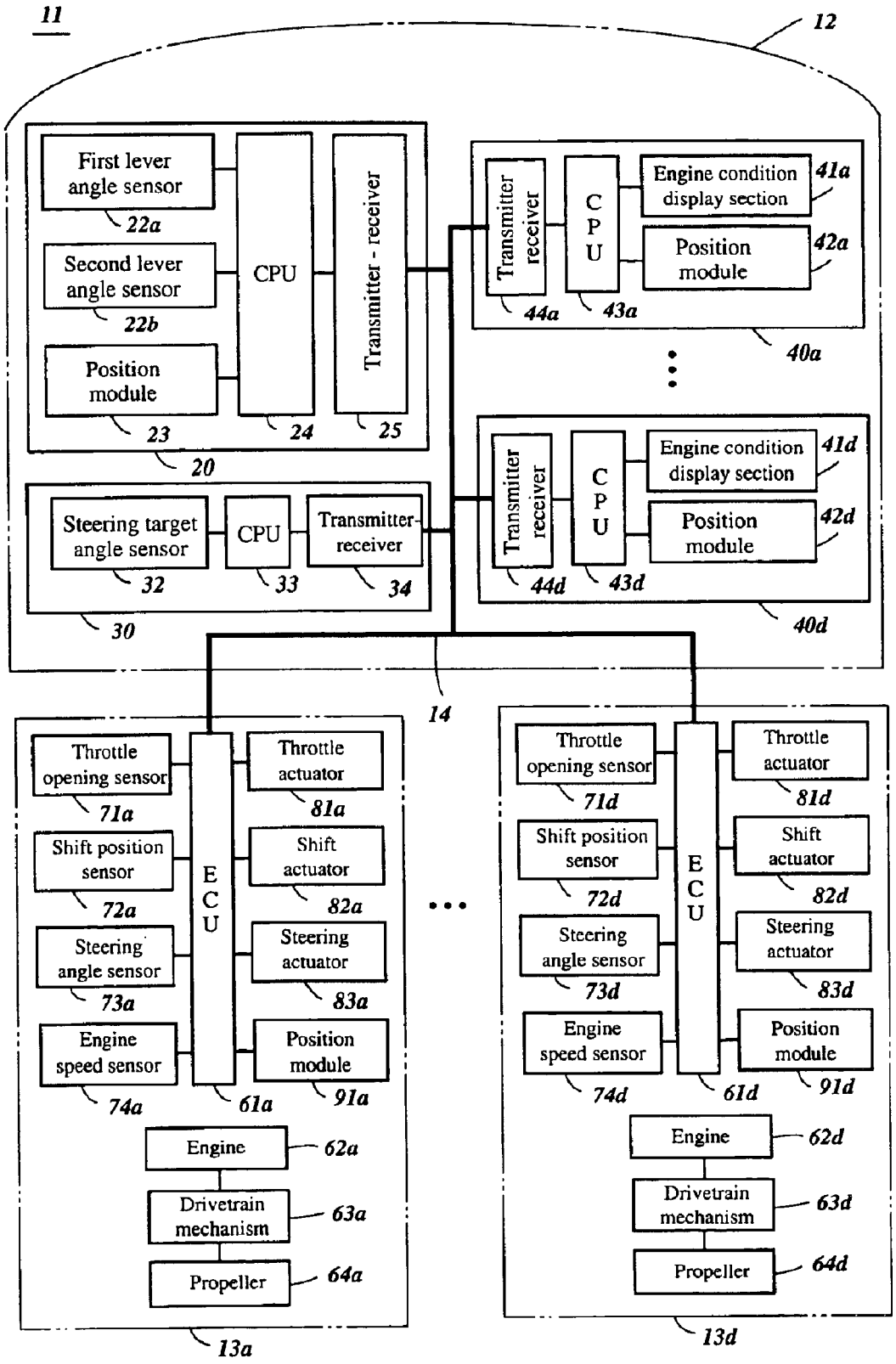
FIG. 2 is a schematic view of the watercraft whocn in FIG. 1 and a network connecting the plurality of outboard motors with the remote control and display devices, wherein each of the remote control, display devices, and outboard motors include a position module.

FIG. 2 is a block diagram schematically showing the inboard LAN (Local Area Network) system 11 within the hull 12. The LAN 11 connects the devices 40*a*–40*d*, 20, 30 in the hull 12 to the outboard motors 13*a*–13*d*. The LAN 11 may be constructed by either wire, wirelss (such as infrared, radio wave, ultrasonic waves), or other means of connecting a LAN. Thus, each of the devices in connected by the LAN 11 include a device for communicating in accordance with a networking protocol. The LAN 11 is described below in greater detail.

The remote control 20 is comprised of lever angle sensors 22*a* and 22*b* for sensing the angle of the remote control levers 21*a* and 21*b*, respectively. The remote control further comprises a position module 23, a CPU 24, and a transmitter-receiver 25. The remote control 20 is described below in greater detail.

The steering unit 30 has a steering target angle sensor 32 connected to the steering wheel 31, a CPU 33, and a transmitter-receiver 34. The steering unit 30 is also described below in greater detail.

The engine condition display devices 40*a*–40*d* have engine condition display sections 41*a*–41*d* for displaying at least one condition of a respective engine in the array. The condition display devices further comprise position modules 42*a*–42*d*, CPUs 43*a*–43*d*, and transmitter-receivers 44*a*–44*d*, respectively. The display devices 40*a*–40*d* are described below in greater detail.

With reference to FIGS. 1 and 2, the general construction of the outboard motors 13*a*–13*d* is set forth below. Throughout the description of the internal components of the outboard motors, only the outboard motor 13*a* is referenced directly. However, the other outboard motors 13*b*–13*d* can be constructed in an identical or similar manner. Additionally, components of the outboard motors 13*b*–13*d* are identified using the same reference numerals used for the corresponding components of the outboard motor 13*a*, except that the "a" has been changed to a "b", "c" or "d".

The outboard motor 13*a* comprises a drive unit and a bracket assembly (not shown). The bracket assembly comprises a swivel bracket and a clamping bracket. The swivel bracket supports the drive unit for pivotal movement about a generally vertically extending steering axis. The clamping bracket, in turn, is affixed to a transom of the watercraft 10 and supports the swivel bracket for pivotal movement about a generally horizontally extending axis. A hydraulic tilt system (not shown) can be provided between the swivel bracket and clamping bracket to tilt the drive unit up or down. If this tilt system is not provided, the operator may tilt the drive unit manually. Since the construction of the bracket assembly is well known in the art, a further description is not believed to be necessary to enable those skilled in the art to practice the invention.

As used throughout this description, the terms "forward," "front" and "fore" mean at or toward the side of the bracket assembly, and the terms "rear," "reverse" and "rearwardly" mean at or to the opposite side of the front side, unless indicated otherwise.

The drive unit includes a power head disposed at an upper portion of the drive unit, and a driveshaft housing connecting the power head to a lower unit. The outboard motor 13*a* also includes an engine 62*a* disposed in the power head. A drivetrain mechanism 63*a* extends through the driveshaft housing and connects the engine 62*a* to a propeller 64*a* in the lower unit.

The engine 62*a* preferably operates on a four stroke or two stroke combustion principle. However, the engine 62*a* can be configured to operate on other combustion principles (e.g., diesel, rotary, etc).

The engine 62*a* includes a cylinder block. The cylinder block defines one or a plurality of cylinder bores extending generally horizontally and spaced generally vertically from each other. The engine can include multiple cylinder blocks defining multiple cylinder banks. As such, the engine 62*a* can be an in-line, V-type, or W-type engine.

A piston (not shown) reciprocates in each cylinder bore. A cylinder head assembly is affixed to one end of each cylinder block and defines combustion chambers with the pistons and the cylinder bores. The other end of each cylinder block is closed with a crankcase member defining a crankcase chamber.

A crankshaft extends generally vertically through the crankcase chamber. The crankshaft is connected to the pistons by connecting rods and rotates with the reciprocal movement of the pistons within the cylinder bores. The crankcase member is located at the forward most position of the power head, and the cylinder block and the cylinder head assembly extend rearwardly from the crankcase member.

The engine includes an air induction system and an exhaust system. The air induction system is configured to supply air charges to the combustion chambers through at least one intake passage. A throttle body (not shown) supports a throttle valve (not shown) therein for pivotal movement. Where multiple throttle bodies are used, the corresponding valve shafts are linked together to form a single valve shaft assembly that passes through the throttle bodies.

In the illustrated embodiment, a throttle actuator 81*a* (FIG. 2) is operatively connected to the throttle valve. For example, the throttle actuator 81*a* can be in the form of a stepper motor connected to the throttle valve shaft. The throttle actuator 81*a* is connected to and controlled by the ECU 61*a,* based on the position of the lever 21*a,* described in greater detail below. When the actuator 81*a* rotates the throttle shaft, the throttle valve is rotated within the throttle body, thereby changing the opening of the throttle valve.

A throttle valve opening sensor or "throttle valve position sensor" 71*a* is configured to detect a position of the throttle valve and generate a signal indicative of the opening of the throttle valve. A signal from the position sensor 71*a* is sent to the ECU 61*a* for use in controlling various aspects of engine operation including, for example, but without limitation, fuel supply control and/or ignition control which is described below. The signal from the throttle valve opening sensor 71*a* corresponds to the engine load in one aspect as well as the throttle opening.

The air induction system can also include a bypass passage or idle air supply passage that bypasses the throttle valves (not shown). The engine 62*a* also preferably includes an idle air adjusting unit (not shown) which is controlled by the ECU 61*a*.

The exhaust system (not shown) is configured to discharge burnt charges or exhaust gasses outside of the outboard motor 13*a* from the combustion chambers.

The engine 13*a* also includes a fuel control system (not shown). The fuel control system can be in the form of a carburated system, an induction fuel injection system, or a direct fuel injection system. Depending on which type of system is used, the ECU 61*a* can be configured to control an amount of fuel delivered.

The engine 62*a* can also include an ignition system (not shown) configured to ignite compressed air/fuel charges in the combustion chamber. Where the engine 62*a* is a non-diesel engine, at least one spark plug (not shown) is fixed on the cylinder head assembly and exposed into the combustion chamber. The spark plug ignites the air/fuel charge at a certain timing as determined by the ECU 61*a* to burn the air/fuel charge therein.

The outboard motor 13*a* also includes a driveshaft housing depending from the power head which encloses a drivetrain mechanism 63*a* connecting the crankshaft to a propeller 64*a*. The driveshaft housing supports a driveshaft (not shown) which is driven by the crankshaft of the engine 62*a*. A lower unit (not shown) depends from the driveshaft housing and supports a propeller shaft driven by the driveshaft. The propeller shaft extends generally horizontally through the lower unit. A propeller 64*a* is affixed to an outer end of the propeller shaft and is thereby driven.

The drivetrain mechanism 63*a* also includes a transmission (not shown) provided between the driveshaft and the propeller shaft. The transmission connects the driveshaft and the propeller shaft, which lie generally normal to each other (i.e., at a 90° angle), with a bevel gear combination.

A shifter mechanism (not shown) is configured to shift the transmission between forward, neutral, and reverse positions. In the illustrated embodiment, the outboard motor 13*a* also includes a shift actuator 82*a* configured to cause the shift mechanism to shift between the forward, neutral, and reverse gear positions. A shift position sensor 72*a* is configured to detect the gear position and generate a signal indicative of the gear position. As noted above, the lever 21*a* is connected to the ECU 61*a*. Thus, the ECU 61*a* can control the shift actuator 82*a* based on the position of the lever 21*a,* described in more detail below.

As noted above, the ECU 61*a* controls engine operations including fuel supply, and firing of the spark plugs, according to various control maps stored in the ECU 61*a*. In order to determine appropriate control scenarios, the ECU 61*a* utilizes maps and/or indices stored within the ECU 61*a* with reference to data collected from various sensors. For example, the ECU 61*a* may refer to data collected from the throttle valve position sensor 71*a* and other sensors provided for sensing engine running conditions, ambient conditions, or conditions of the outboard motor 13*a* that will affect engine performance.

In the illustrated embodiment, there is provided, associated with the crankshaft, at least one engine speed sensor 74*a* which is configured to generate a signal indicative of the speed of the engine 62*a*. For example, the speed sensor 74*a* can define a pulse generator that produces pulses which are, in turn, converted to an engine speed within the ECU 61*a* or another separate converter (not shown).

The outboard motor 13*a* also includes a steering angle sensor 73*a* that is configured to detect an angular position of the outboard motor 13*a* relative to the transom of the watercraft 10 and to generate a signal indicative thereof. The outboard motor 13*a* also includes a steering actuator 83*a* that is configured to change an angular position of the outboard motor 13*a* relative to the transom of the watercraft 10. For example, the steering actuator 83*a* can comprises a hydraulic steering actuator typically used in the outboard motor arts, or any other known steering actuator. The steering actuator 83*a* is connected to the ECU 61*a* and is thus controlled by the ECU 61*a* based on the position of the steering wheel 31.

The above noted sensors correspond to merely some of those conditions which may be sensed for purposes of engine control and it is, of course, practicable to provide other sensors such as an oxygen sensor, a water temperature sensor, a lubricant temperature sensor, intake air pressure sensor, intake air temperature sensor, an engine height sensor, a trim angle sensor, a knock sensor, a neutral sensor, a watercraft pitch sensor, and an atmospheric temperature sensor in accordance with various control strategies.

Additionally, the ECU 61*a* is configured to process the controls for the outboard motor 13*a*. The ECU 61*a* preferably comprises a Central Processing Unit (CPU), storage (such as RAM and ROM), auxiliary storage devices (such as nonvolatile RAM, hard disk, CD-ROM, and magneto-optical disk), and a clock. The various functions described herein can be programmed into the ECU 61*a* in the form of a computer program. However, one of ordinary skill in the art will recognize that the ECU 61*a* can be comprised of one or a plurality of hard-wired modules configured to perform the functions described herein. Alternatively, the ECU 61*a* can be comprised of one or a plurality of dedicated processors and memories with programs for performing the functions disclosed herein.

As shown in FIG. 2, the motor 13*a* includes a position module 91*a*. The position module 91*a* is configured to store position data indicative of the position of the motor 13*a* relative to the hull 12. For example, the position module 91*a* can be configured to store data indicative of the position of the motor 13*a* relative to the hull 12 or relative the other motors 13*b*–13*d*.

In one embodiment, the position of each of the motors 13*a*–13*d* is represented by their respective place in the order from the portside to the starboard with "1", "2", "3", or "4". The numeral value "1", "2", "3", or "4" corresponds to the physical location of the motors.

The position data can be in the form of a character, symbol, number, or combination thereof as long as this position data differentiates the motors 13*a*–13*d* from each other. It is not necessary for the number and the order of the positions to correspond to a particular order. For example, a position from the portside to the starboard may be indicated with "3", "2", "1", and "4" in turn.

Figure 3:
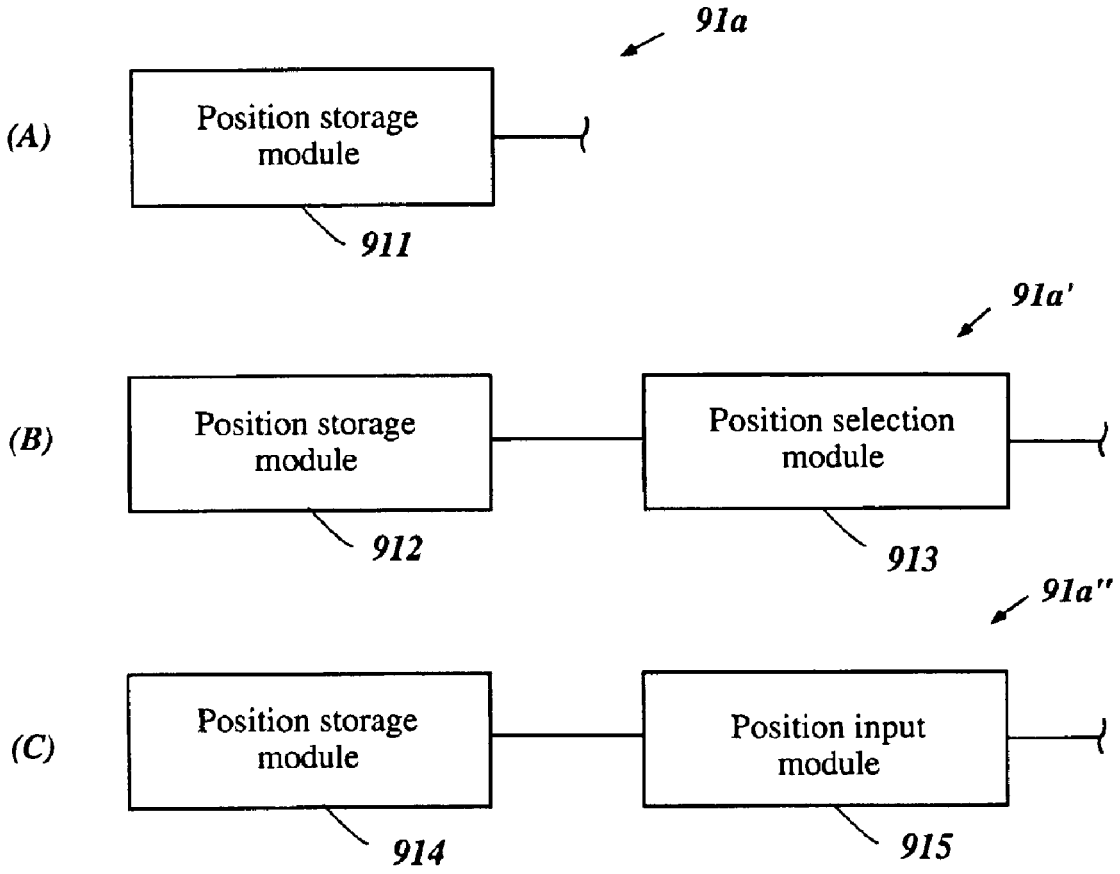
FIG. 3A is a schematic diagram illustrating a position module for the outboard motors illustrated in FIG. 2.
FIG. 3B is a schematic diagram illustrating a modification of the position module illustrated in FIG. 3A.
FIG. 3C is a schematic diagram illustrating a further modification of the position module illustrated in FIG. 3A.

With reference to FIG. 3A, the position module 91*a* can comprise a position storage module 911 configured to store position data indicative of the position of the motor 13*a* relative to the hull 12 or the other motors 13*b*–13*d*. Preferably, in this embodiment, the storage module 911 stores predetermined position data. For example, the position storage module 911 can comprise ROM, nonvolatile RAM, and the like configured to store symbols or characters corresponding to the position data so as to maintain the storage data even after the LAN 11 is turned off. This position data can be stored in the storage module 911 at the time of installation of the module into the motor 13*a*. The term "maintain" used herein includes any configuration capable of electronically storing the position data or maintaining the data in any form such as mechanical including, but without limitation, jumpers or switches.

FIG. 3B illustrates a modification of the position module 91*a* illustrated in FIG. 3A, and is identified generally by the reference numeral 91*a*'. In this modification, the position module 91*a*' can be configured to allow for the selection position data. In one embodiment, the position module 91*a*' comprises a position storage module 912, and a position selection module 913.

The position storage module 912 can be constructed in accordance with the description set forth above with reference to the storage module 911, except as noted below.

The position selection module 913 can be configured to allow a user to manually choose one of a plurality of predetermined position data, and to store the manually selected position data in the storage module 912. For example, in one embodiment, the position selection module 913 includes switches such as, for example, but without limitation, Dual In-line Package (DIP) switches allowing a user choose a switch configuration indicative of the position of the motor 13*a*.

FIG. 3C illustrates another modification of the position module 91*a* illustrated in FIG. 3A, and is identified generally by the reference numeral 91*a*?. In this modification, the position module 91*a*? can be configured to allow a user to input the position of the motor 13*a* relative to the hull. In one embodiment, the position module 91*a*? comprises a position storage module 914, and a position input module 915.

The position storage module 914 can be constructed in accordance with the description set forth above with reference to the storage modules 911 and 912, except as noted below.

In one embodiment, the position input module 915 can be configured to be connected to a computer keyboard or a computer for recieving data indicative of the position of the motor 13*a*.

Optionally, the motor 13*a* can be configured to detect a condition indicative of the position of the motor 13*a*. For example, the motor can include a resistance sensor. In one mode, the resistance detector can be included in the ECU 61*a*. In this mode, the resistance detector can be configured to detect a resistance in the communication conduits connecting the components of the LAN 11, which are generally identified by the numeral 14. In this example, the LAN 11 is configured such that the communication lines 14 have different resistances at the respective positions where the motors 13*a*–13*d* are mounted.

For example, the lines 14 at the mounting position of motor 13*a* can have a resistance in a first resistance range, and the lines 14 at the mounting position of motor 13*b* can have a resistance in a second resistance range different from the first resistance range. In an exemplary but non-limiting embodiment, the first range can be between 0° and 50°, and the second resistance range can be between 50° and 100°. However, these resistances are merely for illustrative purposes.

In this example, the ECU 61*a* can be configured to detect the resistance at the mounting position, and convert the resistance into position data corresponding to the mounting position of the motor 13*a*. For example, ECU 61*a* can further comprises a memory (not shown) with a map correlating resistances with mounting positions. Thus, the ECU 61*a* can be configured to compare the detected resistance with the values in the map, input the data through the position input module 915, which then stores the postion data in the position storage module 914.

FIG. 4 illustrates an exemplary position data stored in any of the position storage modules 911, 912, 914. As such, the position data, the value of which is "1" in this illustrative example, can be referred to during the operation of the motor 13*a*. Thus, when the motor 13*a* communicates with any other component on the LAN 11, the position data can be included so that the other components can associate the transmitted data with the motor 13*a*.

For example, as noted above, the most widely used networking protocols require data to be distributed in packets. Each packet can include a header with identifying information, such as, for example, but without limitation, the intended recipient or the sender. Thus, when the motor 13*a* transmits information across the LAN 11, the motor 13*a* can format the information into a packet in accordance with the networking protocol, and include the position data in the header. Advantageously, the motor 13*a* is configured to send engine operation condition data over the LAN 11, wherein the condition data is identified with the position data. The condition data can be any type of data, including for example, but without limitation, any of the data collected from any of the sensors listed above. In the illustrated embodiment, the ECU 61*a* is configured to perform the function of formatting and transmitting data for communication across the LAN 11, as well as receiving data from the other components connected to the LAN 11.

Other components on the LAN 11 that are configured to receive data from the motor 13*a*, can be configured to read the headers of the packets moving through the LAN 11 and accept those packet having the proper header. However, this is merely an example for illustrative purposes. The position data can be included anywhere in the packets transmitted from the motor 13*a*.

It is not necessary that all of the motors 13*a*–13*d* have the identical construction. For example, the motors can have different components and operate under different principles, e.g., diesel, rotary, two-stroke, four-stroke, etc. Additionally, the motors 13*a*–13*d* can have different sensors. For example, in one embodiment, only the outboard motor 13*a* includes an atmospheric pressure sensor. The atmospheric pressure sensor is used for detecting atmospheric pressure which directly affects the mass of air in a given volume. When at high altitudes (low atmospheric pressure) the amount of air in a given volume is less than that at low altitudes. The difference of the atmospheric pressure, however, between the motors 13*a*–13*d* is nominal because of their close proximity. The ECU 61*a* of the engine 13*a* can be configured to transmit the atmospheric pressure data over the LAN 11 to be received by all of the other motors 13*b*–13*d*.

With reference to FIGS. 1 and 2, the remote control 20 includes lever angle sensors 22*a* and 22*b* configured to detect the position or tilt (angle) of the remote control levers 21*a* and 21*b*, respectively. The lever angle sensors 22*a*,22*b* are configured to sense the position in intervals in a stepwise manner. Optionally, the sensors 22*a*,22*b* can be configured to detect the position of the levers 21*a*, 21*b* continuously in a proportional manner.

The remote control 20 also includes a central processing unit 24 which is configured to manage the operations of the entire remote control 20. A transmitter-receiver 25 transmits and receives data from the LAN 11 in accordance with the networking protocol in operation therein.

The remote control 20 also includes a position storage module 23 that is configured to store position data indicative of the positions of the motors 13*a*–13*d* that are respectively controlled by the levers 21*a*, 21*b*. For example, the storage module 23 can be configured to store data indicating that lever 21*a* corresponds to motors 13*a*, 13*b*, and that lever 21*b* corresponds to motors 13*c*, 13*d*.

Figure 5:
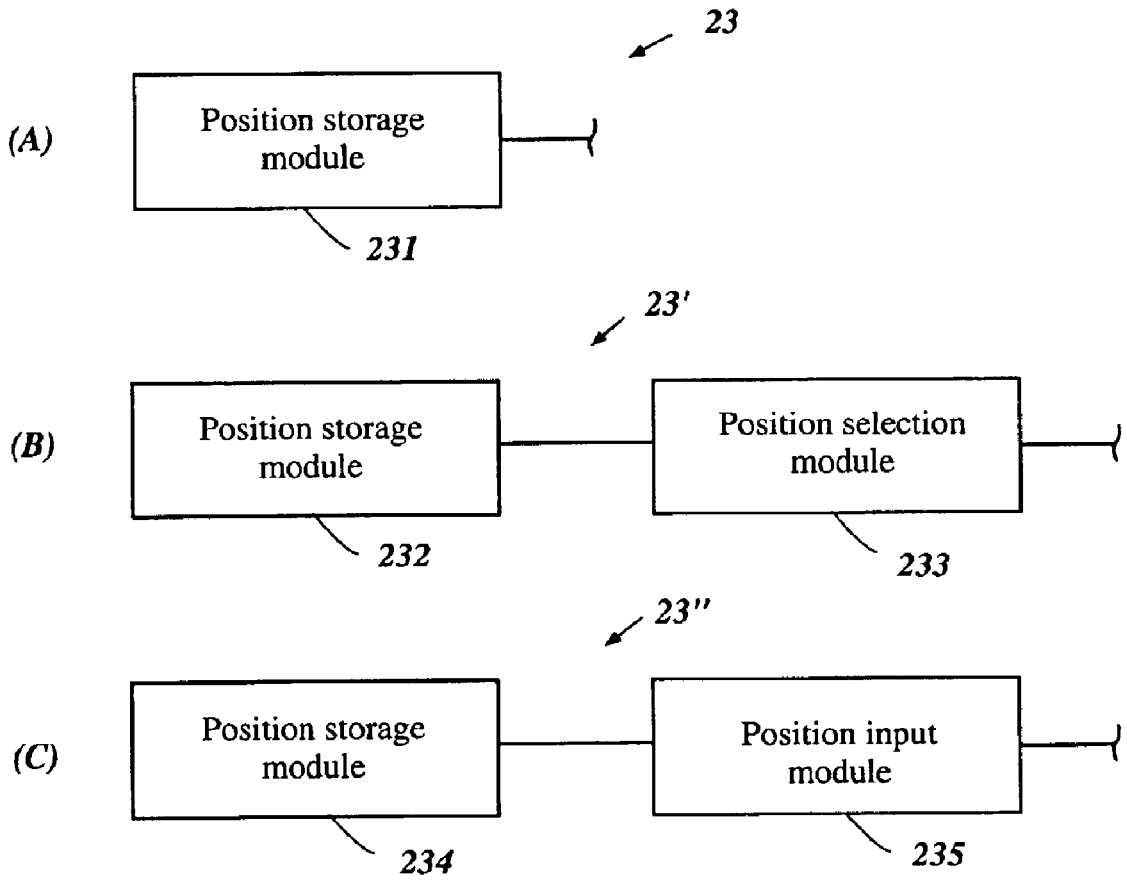
FIG. 5A is a schematic diagram illustrating a position module for the remote control illustrated in FIG. 2.
FIG. 5B is a schematic diagram illustrating a modification of the position module illustrated in FIG. 5A.
FIG. 5C is a schematic diagram illustrating a further modification of the position module illustrated in FIG. 3A.

FIG. 5A schematically illustrates one embodiment of the storage module 23. The storage module 23 can be comprised of a position storage module 231 constructed in accordance with the construction of the position storage modules 911, 912, and 914 described above, except as noted below.

FIG. 6 illustrates an exemplary position data stored in the storage module 231. As such, FIG. 6 shows that the lever 21*a* corresponds to motors 13*a*, 13*b*, (positions 1 and 2) and that lever 21*b* corresponds to motors 13*c*, 13*d* (positions 3 and 4).

FIG. 5B illustrates a modification of the position module 23 illustrated in FIG. 5A, and is identified generally by the reference numeral 23'. In this modification, the position module 23' can be configured to allow for the selection of any of a plurality of predetedmined positon data correlating the levers 21*a*, 21*b* to the motors 13*a*–13*d*. In one embodiment, the position module 23' comprises a position storage module 232, and a position selection module 233.

The position storage module 232 can be constructed in accordance with the description set forth above with reference to the storage module 231, except as noted below.

The position input module 233 can be configured to accept manually input position data, and to store the manually input data in the storage module 232. For example, in one embodiment, the position selection module 913 includes switches such as, for example, but without limitation, Dual In-line Package (DIP) switches allowing a user choose a switch configuration indicative of the position of the motor 13*a*.

FIG. 5C illustrates another modification of the position module 23 illustrated in FIG. 5A, and is identified generally by the reference numeral 23?. The position module 23? includes a position storage module 234 and a position detection module 235. In this modification, the position module 23? can be configured to allow a user to input the position of the motor 13*a* relative to the hull The position storage module 234 can be constructed in accordance with the description set forth above with reference to the storage modules 231 and 232, except as noted below.

In one embodiment, the position input module 235 can be configured to be connected to a computer keyboard or a computer for recieving data indicative of the position of the motor 13*a*.

The CPU 24 is configured to receive the lever position data from the sensors 22*a*,22*b*, and to correlate the lever position data with the motor position data in the position storage module 23. For example, the CPU 24 can sample the output from the sensor 22*a* and create two data sets, each having engine power request data contained therein corresponding to the position data from the sensor 22*a*. The CPU 24 can organize the lever position data into two sets such that one set includes position data indicating one of the positions stored in the position module 23, 23', or 23? as corresponding to the lever 22*a*, and the other set includes position data corresponding to the other position data stored position module 23, 23', or 23? correlated to the lever 22*a*. Additionally, the CPU 24 is configured to perform the same procedure for the lever 21*b* and the corresponding data.

The transmitter-receiver 25 is configured to send the data sets as packets of the LAN 11, to the motors 13*a*–13*d*. The motors 13*a*–13*d* can be configured to accept certain packets from the remote control. For example, as noted above, the motor 13*a* can be configured to accept and apply engine control data, such as a power request data, only if the packet includes the position data corresponding to the motor 13*a*. In one example, the motor 13*a* will only accept and use power request data if it includes the position data "1", which indicates that the power request data is for the motor 13*a*.

However, it is to be noted that although the description set forth above is directed to an embodiment with four motors 13*a*–13*d*, and two levers 21*a*, 21*b*, the number of the outboard motors is not limited to 4. Rather, the remote control 20 can be connected to a watercraft having other numbers of outboard motors (e.g., but without limitation, 2, 3, or 5). Additionally, the ratio of the remote control levers to the number of outboard motor is not limited to 1 or 2. Rather, each lever included in the remote control can control any number of engines, e.g., but without limitation, the ratio of levers to motors can be 1 to 1, or, 1 to 3.

As noted above, the lever 21*a* controls the motors 13*a* and 13*b*, and the lever 21*b* controls the motors 13*c* and 13*d*. If the lever 21*a* is tilted towards the bow and the lever 21*b* is tilted toward the stern, the motors 13*a* and 13*b* are driven in the forward gear while the motors 13*c* and 13*d* are driven in the reverse gear. This allows the watercraft 10 to turn sharply.

With reference to FIG. 2, the steering unit 30 includes a target angle sensor 32, a CPU 33, and a transmitter receiver 34. The target angle sensor 32 is configured to detect the angle of the steering wheel 31, and to generate a signal indicative of the angle.

The CPU 33 is a central processing unit and manages the operations of the entire steering unit 30. As noted above, the target angle sensor 32 outputs a steering control signal (steering target angle signal) indicative of the angle at which the steering wheel 31 is turned. The CPU 33 is configured to sample the signal from the sensor 32 and convert the signal into a steering angle request data. Additionally, the CPU 33 can be configured to combine the steering request data with position data corresponding to one or a combination of the motors 13*a*–13*d*.

The transmitter-receiver 34 is configured to transmit steering request data packeted with position data across the LAN 11 to the motors 13*a*–13*d*. In the illustrated embodiment, the steering unit 30 transmits the same steering data to all the motors 13*a*–13*d*. Thus, the CPU 33 can create steering request data sets with position data for each of the motors 13*a*–13*d* including the same steering request data. Thus, each of the motors can receive the steering request data packet having the appropriate position data, and control the corresponding steering actuators 83*a*–83*d* in accordance with the steering request data.

With reference to FIG. 2, the display devices 40*a*–40*d* respectively provide condition information for indicating the condition of the motors 13*a*–13*d* to the boat operator. An example of the condition information that can be displayed is engine speed, engine oil level, oil pressure, engine temperature, etc. As noted above, each of the display devices 40*a*–40*d*, in the illustrated embodiment, include condition display sections 41*a*–41*d*, position modules 42*a*–42*d*, CPUs 43*a*–43*d*, and transmitter-receivers 44*a*–44*d*, respectively.

The condition display sections 41*a*–41*d* can comprise general purpose display devices, or can be configured to display certain types of information graphically, with text, or a combination of text and graphics. Preferably, the display sections 41*a*–41*d* are analog displays or digital displays such as CRTs (cathode ray tubes) and LCDs (liquid crystal display units).

The CPUs 43*a*–43*d* are comprised of central processing units and manage the operations of each of the display devices 40*a*–40*d*. As noted above, the CPUs 43*a*–43*d* can be in the form of a dedicated, purpose built processor with a memory for running one or a plurality of programs, or a general purpose processor and memory for executing one or a plurality of computer programs.

The transmitter-receivers 44*a*–44*d* perform the receiving and transmitting functions for the display devices 40*a*–40*d* across the LAN 11, described below in greater detail.

Figure 7:
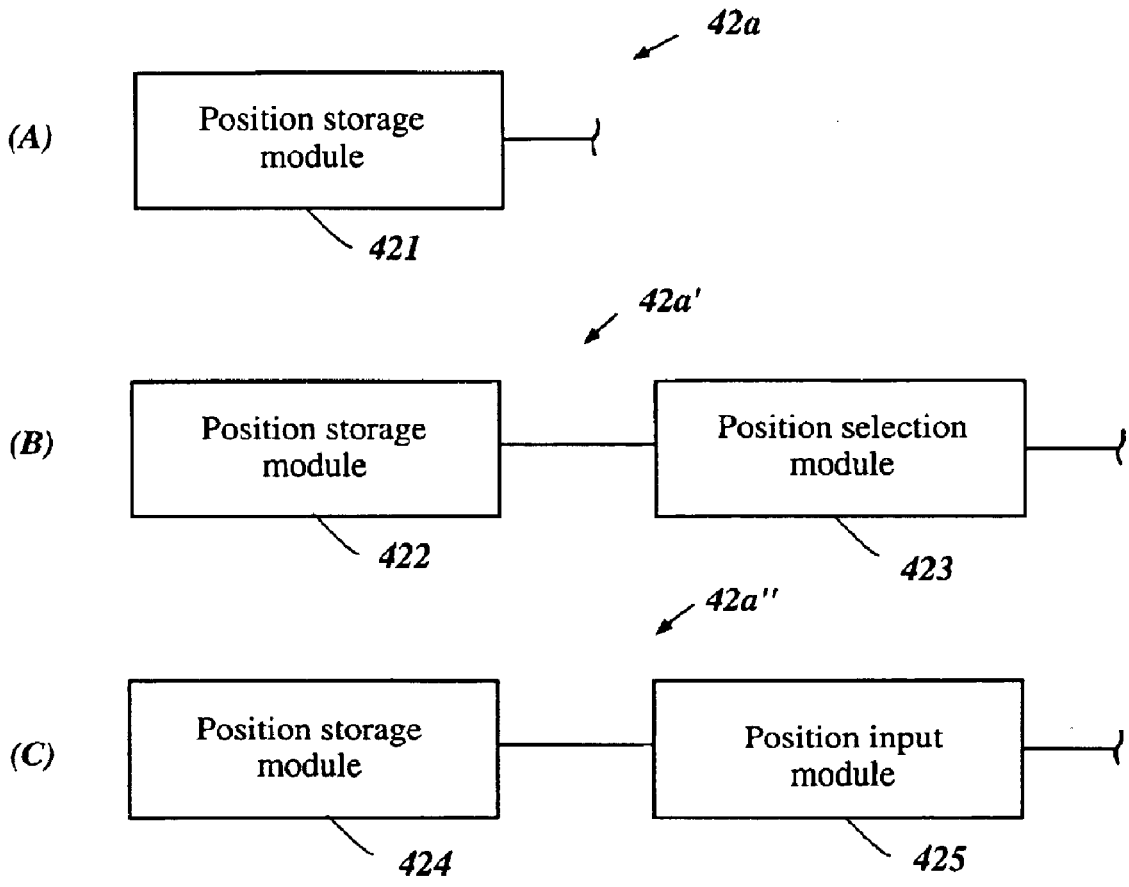
FIG. 7A is a schematic diagram illustrating a position module for the display devices illustrated in FIG. 2.
FIG. 7B is a schematic diagram illustrating a modification of the position module illustrated in FIG. 7A.
FIG. 7C is a schematic diagram illustrating a further modification of the position module illustrated in FIG. 7A.

The position modules 42*a*–42*d* are configured to store position data corresponding to at least one of the motors 13*a*–13*d*, respectively. FIG. 7A illustrates one embodiment of an exemplary position module 42*a*. It is to be noted that the position modules 42*a*–42*d* can be configured in accordance with the description of the position module 42*a* set forth below.

As shown in FIG. 7A, the position module 42*a* can comprise a position storage module 421. The position storage module 421 can be constructed in accordance with the description of the position storage module 911 set forth above with reference to FIG. 3, except as noted below. As such, the storage module 421 stores position data correlating the display device 40*a* with the mounting position of one of the motors 13*a*–13*d*.

Figure 8:
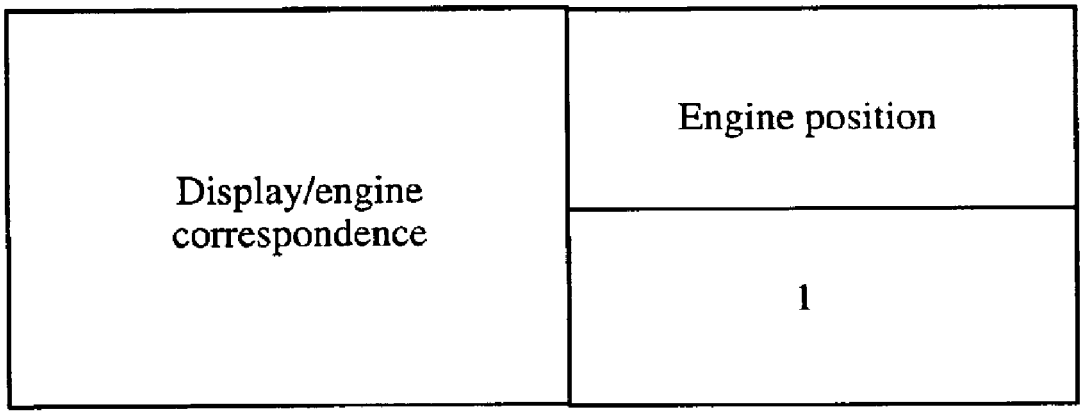
FIG. 8 is a schematic diagram illustrating position information that can be stored in any one of the position modules illustrated in FIGS. 7A–7C.

FIG. 8 illustrates an example of position data that can be stored in the storage module 421. As shown in FIG. 8, the storage module 421 indicates that the display device 40*a* corresponds to mounting position 1, the position where motor 13*a* is mounted.

FIG. 7B illustrates a modification of the position module 42*a* illustrated in FIG. 7A, and is identified generally by the reference numeral 42*a*'. In this modification, the position module 42*a*' can be configured to allow for the selection position data. In one embodiment, the position module 42*a*' comprises a position storage module 422, and a position input module 423.

The position storage module 422 can be constructed in accordance with the description set forth above with reference to the storage module 421, except as noted below.

The position input module 423 can be configured to allow a user to manually choose one of a plurality of predetermined position data, and to store the manually selected position data in the storage module 422. For example, in one embodiment, the position selection module 423 includes switches such as, for example, but without limitation, Dual In-line Package (DIP) switches allowing a user choose a switch configuration indicative of the position of the motor 13*a*.

FIG. 7C illustrates another modification of the position module 42*a* illustrated in FIG. 7A, and is identified generally by the reference numeral 42*a*". In this modification, the position module 42*a*" can be configured to allow a user to input the position of the motor 13*a* to be monitored by the display device 40*a*. In the illustrated embodiment, the position module 42*a*" comprises a position storage module 424, and a position input module 425.

The position storage module 424 can be constructed in accordance with the description set forth above with reference to the storage modules 421 and 422, except as noted below.

In one embodiment, the position input module 425 can be configured to be connected to a computer keyboard or a computer for recieving data indicative of the position of the motor 13*a*

In another embodiment, the display device 40*a* is configured to detect unpaired motors connected to the LAN 11, then store the position data corresponding to the unpaired motor in the position module 42*a*. Thus, the position module 42*a* can configure itself to monitor one of a plurality of outboard motors attached to a corresponding watercraft.

For example, the CPU 43*a* can be configured to query all of the components connected to the LAN 11 for an identification response. As used herein, the term "identification response" is intended to mean any response transmitted across the LAN 11 which includes data indicative of the type of device generating the response. Preferably the identification response also includes position data.

For example, the outboard motors 13*a*–13*d* can be configured to transmit motor identification responses, in response to a query, including position data. Optionally, the motors 13*a*–13*d* can be configured to include device type data having data indicating that a motor has generated the response. The position data can be the same position data described above with reference to the position data stored in the position module 91*a*.

Additionally, the display devices 40*a*–40*d* can be configured to transmit display device identification responses, in response to a query, including position data. Optinally, the display devices can also be configured to include device type data having data indicating that one of the display devices 40*a*–40*d* has generated the response. The position data can be the same position data described above with reference to the position data stored in the position module 42*a*.

Additionally, the position detection module 425 can be configured to look at the responses returned across the LAN 11 and determine if any of the motors 13*a*–13*d* on the LAN 11 are not paired with one of the display devices 40*a*–40*d*. For example, for each of the motors 13*a*–13*d* that are paired with a display device 40*a*–40*d*, the querying display device will receive a response from one motor, e.g., motor 13*a*, with a position data, e.g., 1, and a response from a display device, e.g., device 40*a*, with corresponding position data, e.g., 1. However, if there is an outboard motor connected to the LAN 11 that is not already paired with a display device, the querying display device will only receive a response from a motor correlated to a position, without a corresponding display device. Thus, the display devices can be configured to store the position data from the unpaired motor to the position storage module 424, and thereafter display information from this motor on its display section.

The position detection module 425 can be in the form of a hard-wired electronic module, a dedicated processor and memory containing one or a plurality of programs for execution by the processor, or a general purpose processor and memory storing one or a plurality of programs for execution by the general purpose processor.

Figure 9:
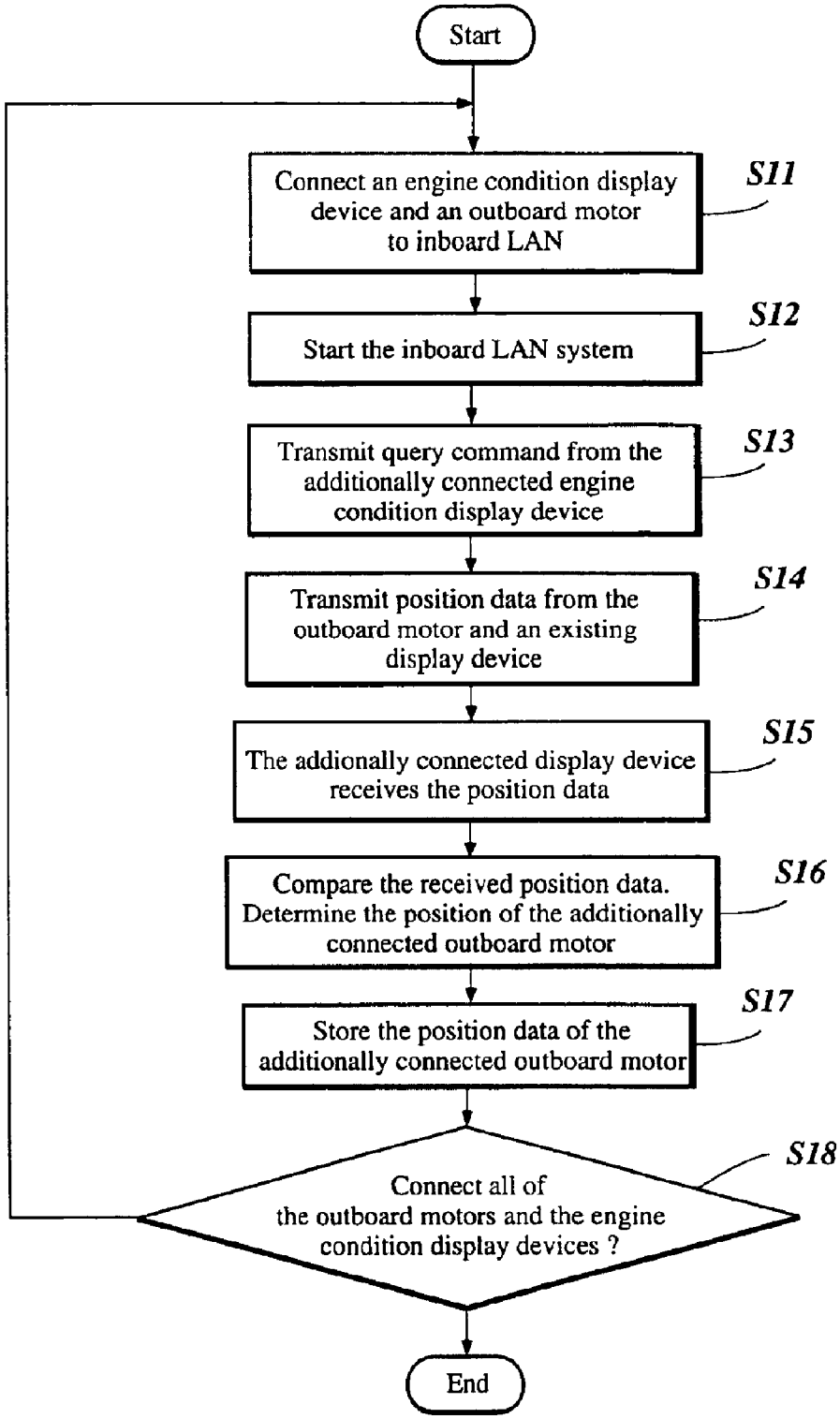
FIG. 9 is a flow diagram showing one example of a method for storing position data into certain of the position modules illstrated in FIG. 2.

A method for correlating a display device, such as the display devices 40*a*–40*d* with an outboard motor, such as the outboard motors 13*a*–13*d* is described below in greater detail with reference to FIG. 9.

During operation, the remote control 20 outputs throttle control signals (target throttle opening signals) and shift control signals (target shift position signals) for controlling the respective throttles and the transmissions of engines 62*a*–62*d* in accordance with operations of the remote control levers 21*a* and 21*b* by a boat operator.

When the operator operates the remote control levers 21*a*,21*b*, control signals are transmitted from the remote control 20. For example, when the levers 21*a*,21*b* initially are pushed forwardly from a central neutral position, the transmissions within the drivetrain mechanisms 63*a*–63*d* are shifted into forward gear by the shift actuators 82*a*–82*d*. The watercraft 10 then moves forward at idle speed. When the levers 21*a*,21*b* initially are tilted toward the stern from the neutral position, the transmissions are shifted into reverse gear by the shift actuators 82*a*–82*d*. Then, the watercraft 10 moves in reverse at idle speed. When the remote control levers 21*a*,21*b* are tilted at an increasing angle toward the bow or stern beyond a predetermined degree, the throttles of the engines 62*a*–62*d* are gradually opened, and the rotational speed of the propellers 64*a*–64*d*, and thus the watercraft speed increases.

In one embodiment the identifying information may be used to control the engines 62*a*–62*d* of the motors 13*a*–13*d*. For example, when the remote control 20 sends engine control data packets across the LAN 11, the ECUs 61*a*–61*d* receive the control packets and compare the position data contained in the packets with the position data stored in the respective position modules 91*a*–91*d*. If the data in the position modules 91*a*–91*d* match the position data in the control data packet, the ECU of the matching motor 13*a*–13*d* responds by controlling the corresponding engine 62*a*–62*d* in accordance with the control data. For example, but without limitation, the ECU can control the throttle actuator 81*a*–81*d* or the shift actuator 82*a*–82*d*. If the position data in the packet does not match the data in the position module 91*a*–91*d*, the corresponding ECU ignores the packet.

The LAN 11 can also be used to transmit information from the motors 13*a* to the display devices 40*a*–40*d*, respectively. For example, the ECUs 61*a*–61*d* detect various conditions of the corresponding engines 62*a*–62*d* during operation. For example, but without limitation, the ECU 61*a* can collect motor condition data from the throttle opening sensor 71*a*, the shift position sensor 72*a*, the steering angle sensor 73*a*, the engine speed sensor 74*a*, as well as numerous other sensors, for example, but without limitation, an oxygen sensor, a water temperature sensor, a lubricant temperature sensor, an intake air pressure sensor, an intake air temperature sensor, an engine height sensor, a trim angle sensor, a knock sensor, a neutral sensor, a watercraft pitch sensor, and an atmospheric temperature sensor.

As noted above, the motors 13*a*–13*d* can transmit any of the data from the sensors noted above, along with position data from the respective position module 91*a*–91*d*, across the LAN 11. The engine condition display devices 40*a*–40*d* receive the coupled engine condition and position data and first compares the position data with the position data stored in the position module 42. If the two position data match, the display device displays the condition data in the corresponding display section 41*a*–41*d*. If the two engine position data do not match, the condition data is ignored and not displayed.

Because each outboard motor 13*a*–13*d* has a corresponding display device 40*a*–40*d*, the corresponding condition data for each outboard motor 13*a*–13*d* can be conveniently displayed in the display devices 40*a*–40*d*.

As noted above, FIG. 9 includes a flow diagram illustrating a method for correlating the display devices 40*a*–40*d* with the motors 13*a*–13*d*. The method begins at a step 11 in which a user connects an engine condition display device 40*a* and an outboard motor 13*a* to the LAN 14. Because the display device 40*a* and the motor 13*a* have just been connected to the watercraft 10, the device 40*a* and the motor 13*a* are not paired, i.e., the display device 40*a* does not have the position data corresponding to the motor 13*a* stored in the position module 42*a*.

The method also preferably includes a step S12, in which the LAN 11 is started. For example, the power to the LAN components is turned on.

The method also includes a step 13 in which a query command is transmitted from the added display device 40*a*, to all of the other display devices and motors connected to the watercraft 10. In this example, the query command is transmitted to motor 13*a*. however, if other display devices and motors were connected, the query command would be transmitted to all such devices. The query command is configured to request that all of the other display devices and motors respond with an identification response including position data stored therein. Optionally, all of the display devices can be configured to automatically transmit the query command when switched on, or connected to the LAN 11.

In a step 14, all of the other display devices and outboard motors receive the query command and reply by sending the identification response including the position data stored in each device.

In a step S15, the added display device 40*a*, which is the display device that transmits the query command, receives the identification responses. In a step 16, the display device 40*a* compares the position data included in the received identification response. This comparison can be used to determine to which motor the display device 40*a* should be connected. Preferably, the display device compares all of the identification responses to determine if there are any paired display devices and motors. The display device then ignores the position data of all the paired devices and motors, and looks for a position data that is included in only one identification response. This response is assumed to have been transmitted from a motor that is not already paired with a display device. Thus, the querying display device stores this position data in the position module.

In the condition that only a single pair of display devices and outboard motors is connected to the LAN 11, e.g., device 40*a* and motor 13*a,* the identification response is sent only from the outboard motor 13*a.* Thus, the device 40*a* stores the position data included in the identification response from the motor 13*a* in the position module 42*a,* e.g., position data=1.

In a step S18, the steps S11–S17 are repeated until all of the desired motors and display devices are installed. When a second motor-display device pair, e.g., motor 13*b* and display device 40*b,* is added to the LAN 11, and step S14 of the method is reached, the display device 40*b* is the querying display device. Thus, the display device 40*a* and the motors 13*a,* 13*b* transmit identification responses. As an illustrative example, the display device 40*a* and the motor 13*a* would respond with position data=1, and the motor 13*b* would respond with position data=2.

In the step S17 of this example, the display device 40*b* would eliminate the responses from the display device 40*a* and the motor 13*a,* because these response contain the same position data, i.e., position data=1. Thus, the display device 40*b* stores the position data=2, and is thereby paired with the motor 13*b.* In other words, the position data from a pair of the display device 40*a* and outboard motor 13*a* will correspond with each other, and only the position data transmitted from the added outboard motor 13*b* will be left.

Once all of the engine condition display devices 40*a*–40*d* and the outboard motors 13*a*–13*d* are connected to the inboard LAN 11, the procedures from the steps S11 through S17 are repeated (step S18) until all of the outboard motors 13*a*–13*d* are paired with display devices 40*a*–40*d.*

The embodiments of the present invention are not limited to those embodiments described above and various changes and modifications may be made without departing from the spirit and scope of the present invention. Available engine position identifying information is not limited to the shift and throttle control and the display of the engine condition. It is with in the scope of the present invention any time it is advantageous to identify the position of an engine with in an array of engines.

What is claimed is:

1. An outboard motor comprising, an engine, a position module configured to store position data indicative of a mounting position of the outboard motor, at least one sensor configured to detect a condition of the engine and to generate an engine condition signal indicative of the condition, and an output module configured to output data indicative of the condition and the position packeted together.

2. The outboard motor of claim 1, wherein the output device comprises a network transmission module configured to packet the condition and position data and to transmit the packet through a network disposed in a watercraft.

3. The outboard motor of claim 1, wherein the outboard motor is mountable in a plurality of different positions on a watercraft.

4. The outboard motor of claim 1 additionally comprising a position sensor configured to detect a position at which the outboard motor is mounted to a watercraft.

5. The outboard motor of claim 4, wherein the position sensor is configured to detect an electrical resistance and generate a signal indicative of the electrical resistance.

6. An outboard motor comprising, an engine, a position module configured to store position data indicative of a mounting position of the outboard motor, at least one sensor configured to detect a condition of the engine and to generate an engine condition signal indicative of the condition, an output module configured to output data indicative of the condition and the position, a position sensor configured to detect a position at which the outboard motor is mounted to a watercraft, wherein the position sensor is configured to detect an electrical resistance and generate a signal indicative of the electrical resistance, and a map correlating electrical resistance to position.

7. A propulsion unit condition display comprising a position module configured to store position data indicative of a position at which a propulsion unit is mounted to a watercraft, a communication module configured to receive a signal containing position data and propulsion unit condition data packeted together, and a display device configured to display propulsion unit condition data that is received by the communication module and which corresponds to position data stored in the position module.

8. A propulsion unit condition display comprising a position module configured to store position data indicative of a position at which a propulsion unit is mounted to a watercraft, a communication module configured to receive a signal containing position data and propulsion unit condition data, and a display device configured to display propulsion unit condition data that is received by the communication module and which corresponds to position data stored in the position module, wherein the position module is configured to store data indicative of any of a plurality of different positions at which the propulsion unit could be mounted to the watercraft.

9. A propulsion unit condition display comprising a position module configured to store position data indicative of a position at which a propulsion unit is mounted to a watercraft, a communication module configured to receive a signal containing position data and propulsion unit condition data, and a display device configured to display propulsion unit condition data that is received by the communication module and which corresponds to position data stored in the position module a position selection module configured to allow any of a plurality of different position data to be stored in the position module.

10. A propulsion unit condition display comprising a position module configured to store position data indicative of a position at which a propulsion unit is mounted to a watercraft, a communication module configured to receive a signal containing position data and propulsion unit condition data, a display device configured to display propulsion unit condition data that is received by the communication module and which corresponds to position data stored in the position module, a position selection module configured to allow any of a plurality of different position data to be stored in the position module, and-wherein the selection module comprises at least one physical switch.

11. A network on a watercraft comprising at least a first propulsion unit condition display configured to display a condition of a first propulsion unit connected to the watercraft, at least one sensor configured to detect a condition of the first propulsion unit and to generate a signal including condition data indicative of the condition, and a communication device configured to transmit across the network the condition data packeted with position data indicative of a first position at which the propulsion unit is mounted to the watercraft.

12. The network of claim 11, additionally comprising at least a second propulsion unit condition display device, a second sensor configured to detect a second condition of a second propulsion unit mounted to the watercraft and to generate second data indicative of the second condition, and a second communication device configured to transmit across the network the second data packeted with second position data indicative of a second position at which the second propulsion unit is mounted to the watercraft.

13. A network on a watercraft comprising at least a first propulsion unit condition display configured to display a condition of a first propulsion unit connected to the watercraft, at least one sensor configured to detect a condition of the first propulsion unit and to generate a signal including condition data indicative of the condition, and a communication device configured to transmit across the network the condition data packeted with position data indicative of a first position at which the propulsion unit is mounted to the watercraft, wherein the communication device is configured to transmit the packet in the form of radio waves.

14. A method of correlating a display device to one of a plurality of propulsion units connected to a network, the method comprising transmitting a query command requesting an identification response from all display devices and propulsion units connected to the network wherein the identification response includes position data, receiving identification responses from the display devices and motors connected to the network, and determining if there are any identification responses with unique position data.

15. The method according to claim 14 additionally comprising storing the unique position data in a position module.

16. The method according to claim 14, wherein transmitting the query command comprises transmitting a query from a first display device connected to the network.

17. The method according to claim 16 additionally comprising storing the unique position data in a position module in the first display device.

18. The method according to claim 14 additionally comprising receiving condition data coupled with position data from one of the motors and comparing the position data from the motor with the position data stored in the position module.

19. A watercraft comprising an outboard motor, a network, at least one other device connected to the network and communicating with the outboard motor through the network, and means for packing together condition data of the device and position data of the device indicative of a position at which the outboard motor is mounted to the watercraft.

20. An outboard motor comprising, an engine, a position module configured to store position data indicative of a mounting position of the outboard motor, at least one sensor configured to detect a condition of the engine and to generate an engine condition signal indicative of the condition, an output module configured to output data indicative of the condition and the position, and a receiving module configured to accept data from a network only if the data includes position data corresponding to the position data stored in the position module.

21. An outboard motor comprising, an engine, a position module configured to store position data indicative of a mounting position of the outboard motor, at least one sensor configured to detect a condition of the engine and to generate an engine condition signal indicative of the condition, and an output module configured to output data indicative of the condition and the position, wherein the outboard motor is mountable in a plurality of different positions on a watercraft, and wherein the outboard motor is configured to communicate with at least one additional outboard motor through a network.

22. A propulsion unit condition display comprising a position module configured to store position data indicative of a position at which a propulsion unit is mounted to a watercraft, a communication module configured to receive a signal containing position data and propulsion unit condition data, and a display device configured to display propulsion unit condition data that is received by the communication module and which corresponds to position data stored in the position module, wherein the display is configured to be connected to at least one additional display and at least a plurality of propulsion units over a network.

* * * * *

UNITED STATES PATENT AND TRADEMARK OFFICE

CERTIFICATE OF CORRECTION

PATENT NO. : 6,872,106 B2
DATED : March 29, 2005
INVENTOR(S) : Isao Kanno

It is certified that error appears in the above-identified patent and that said Letters Patent is hereby corrected as shown below:

Title page,
Item [73], Assignee, change "Kabuskiki" to -- Kabushiki --.
Item [57], ABSTRACT,
Line 2, delete "a" and insert -- an --.

Column 16,
Line 54, delete "and-wherein" and insert -- and wherein --.

Column 18,
Line 4, delete "packing" and insert -- packeting --.

Signed and Sealed this

Fourth Day of October, 2005

JON W. DUDAS
*Director of the United States Patent and Trademark Office*